United States Patent [19]

Lee et al.

[11] Patent Number: 5,028,047

[45] Date of Patent: Jul. 2, 1991

[54] AMUSEMENT DEVICES

[75] Inventors: James S. W. Lee; Kwan C. Keung, both of Kowloon, Hong Kong

[73] Assignee: C. J. Associates, Ltd., Monrovia, Liberia

[21] Appl. No.: 504,542

[22] Filed: Apr. 4, 1990

[51] Int. Cl.[5] ..... A63F 9/00

[52] U.S. Cl. ..... 273/447; 273/DIG. 24

[58] Field of Search ..... 273/1 GG, 1 G, 1 GS, 273/DIG. 24

[56] References Cited

U.S. PATENT DOCUMENTS

| | | | |
|---|---|---|---|
| 3,578,319 | 5/1971 | Kohner et al. | 273/1 GG |
| 3,717,341 | 2/1973 | Blanton, Jr. | 273/1 G |
| 3,734,509 | 5/1973 | Glass et al. | 273/DIG. 24 X |
| 4,412,682 | 11/1983 | Rehkemper et al. | 273/1 GG |
| 4,863,164 | 9/1989 | Mizunuma | 273/1 GG |

*Primary Examiner*—Paul E. Shapiro

*Attorney, Agent, or Firm*—Laff, Whitesel, Conte & Saret

[57] ABSTRACT

A game apparatus has a housing and a removable lid for covering the housing. A brief flash of high-intensity illumination is provided when the lid is removed. A number of playing pieces randomly positioned within the housing receive the illumination of the flash. The playing pieces briefly radiate color-coded visible light after receiving the flash, forming a random pattern of colored light. At least two players may view the game pieces to form impressions of the locations of the playing pieces while they are radiating the light. Each player must rely upon his memory as to where his color of playing pieces are located. The players use an implement to remove the game pieces in turn according to his memory of where colors assigned to him are located.

2 Claims, 3 Drawing Sheets

AMUSEMENT DEVICES

This invention combines a material and an existing technology into an application of a toy or game.

The material we are referring to is a photochromic ink, through several material manufacturers have claimed or either possessed a patent or a patent pending primarily related to the manufacturing process know-how.

The existing technology we are referring to is an existing product of its own, which is a "flash", commonly used and applied with cameras.

What we have discovered recently that a light source from a "flash" works to reveal the invisible prints of photochromic ink, that may be applied through printing on paper/cardboard, or through weaving into threads or yarns, that may be milled into fabric or piecegoods and also applicable to the photochromic materials, that are made into master batch, which can be blended in other plastic resin, such as PP, PE, PVC in current process to mix with nylon and eventually into other hard plastics such as ABS or HIPS.

We have applied this principle to several game concepts.

Figure 1:
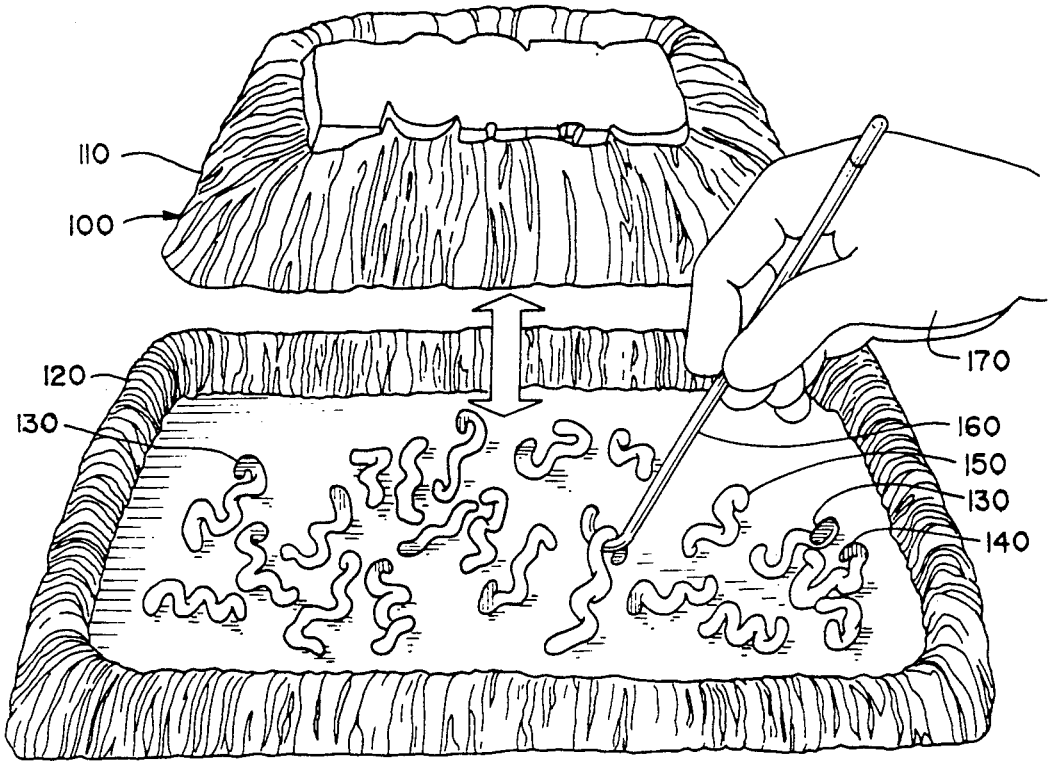
FIG. 1 is a perspective view of a first preferred embodiment of a game apparatus according to the present invention.
Figure 2:
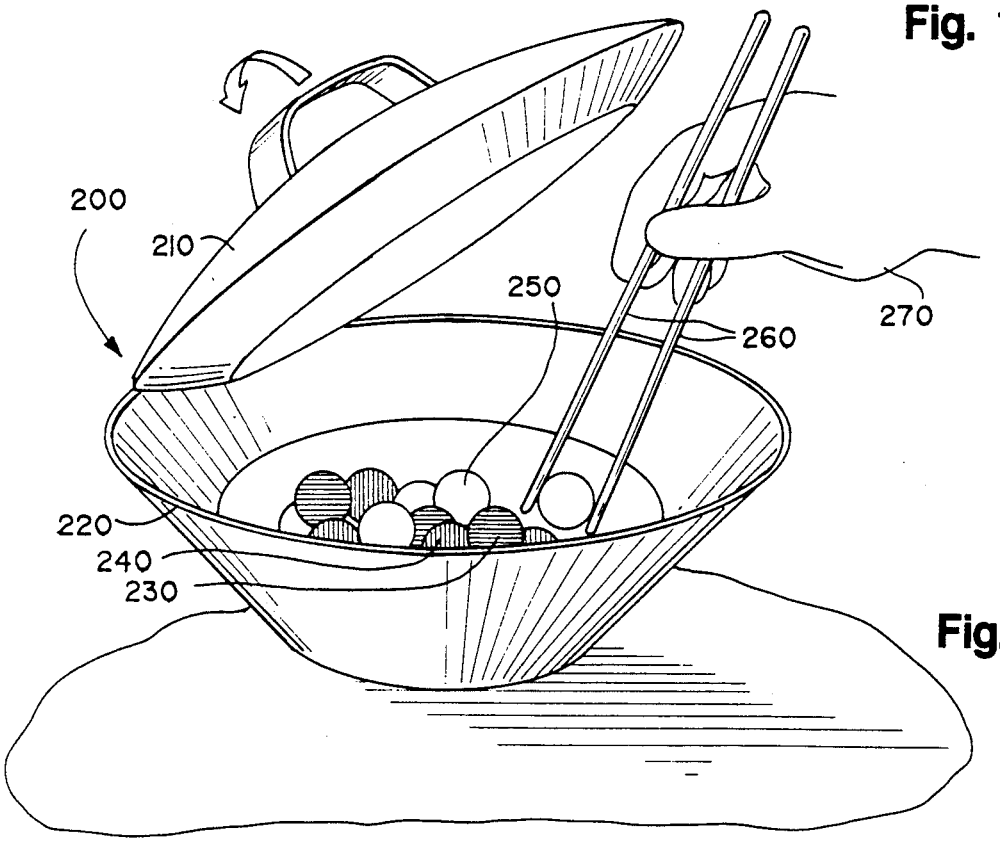
FIG. 2 is a perspective view of a second preferred embodiment of a game apparatus according to the present invention.
Figure 3:
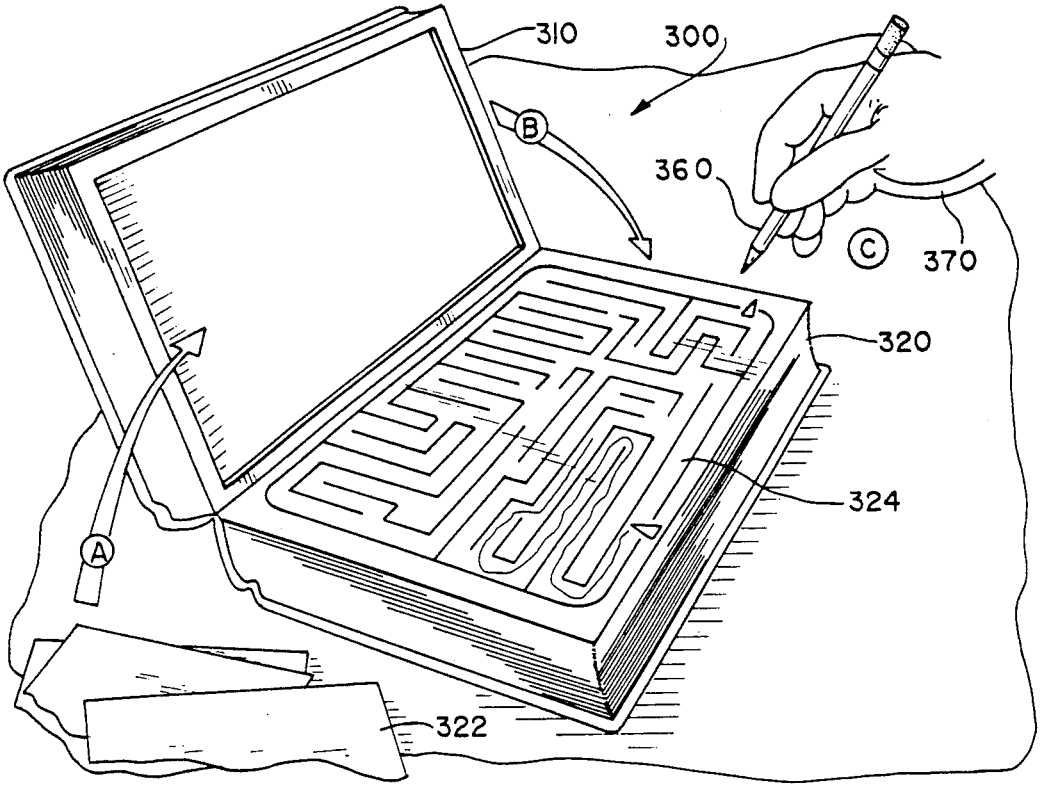
FIG. 3 is a perspective view of a third preferred embodiment of a game apparatus according to the present invention.
Figure 4:
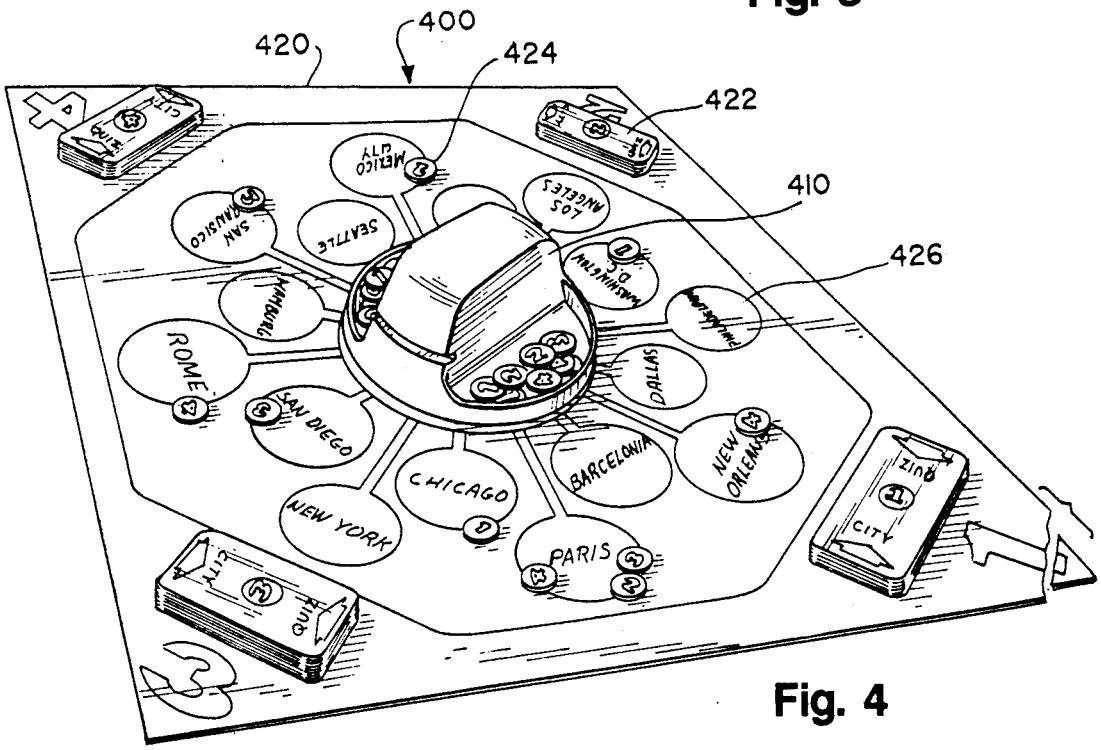
FIG. 4 is a perspective view of a fourth preferred embodiment of a game apparatus according to the present invention.
Figure 5:
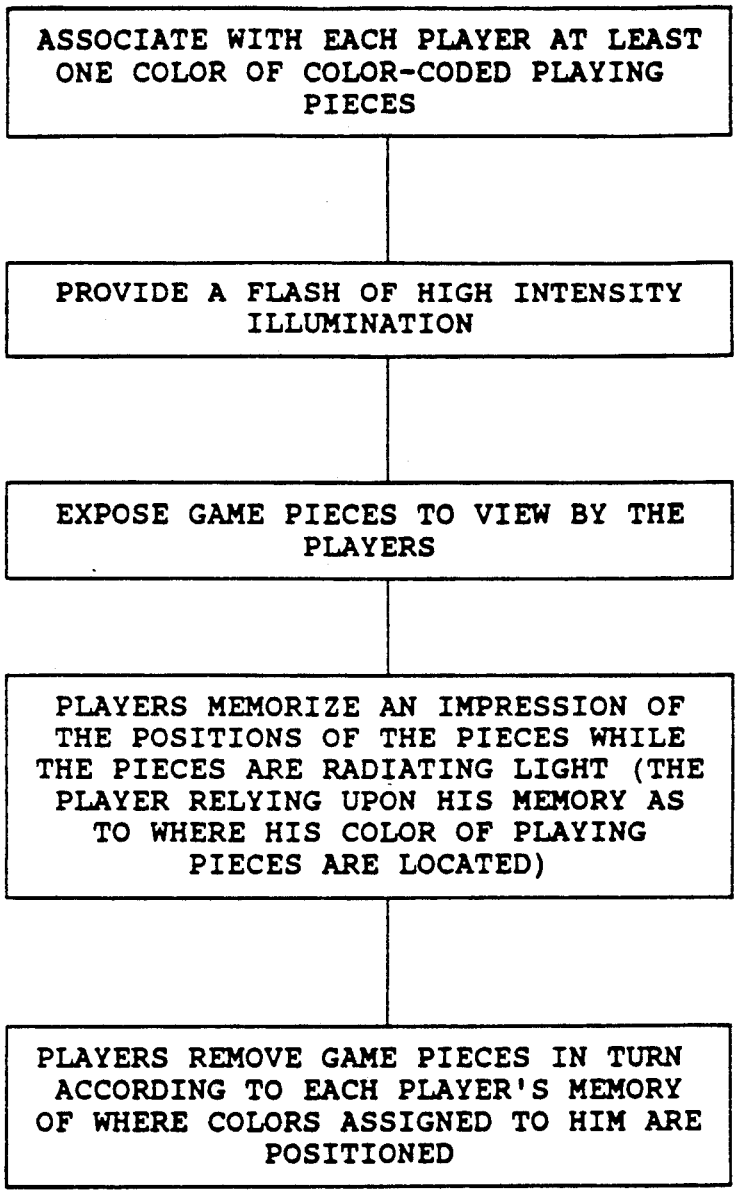
FIG. 5 is a flow-chart depicting a method of playing a game according to the present invention.

WORMS 100 (FIGS. 1 and 5)

OBJECT OF THE GAME:

The player of the game with the most correct worms wins.

COMPONENTS OF THE GAME:

Top Cover 110—Contains flash unit (mound of dirt)

Base 120—Playing surface (lower half of mound)

Worms—All look white but some with blue photochromic tails 140, some with purple tails 130 and some with no photochromic colored tails 150.

Pickup Hooks 160—One blue and one purple to pick up worms.

DESCRIPTION OF THE GAME

The top flash unit 110 is flashed, then removed. First player 170 must try to pick up his colored worms 130 with his pickup hook 170 before the color has faded. In his haste and as the colors are fading he might make a mistake, and pick up a colorless one 150 (a dummy) or even his opponents color 140. Taking alternate turns, when both feel each has all his worms, each player checks (by flashing) his worms. If a player has a dummy or his opponents worm, that amount is deducted from his score.

CHOPSTICKS 200 (FIG. 2)

OBJECT OF THE GAME:

The player with the most correct dumplings wins.

COMPONENTS OF THE GAME:

Top Cover 210—Contains flash unit.

Base 220—Looks like wok.

Dumplings—some covered with blue photochromic paint 240, some with purple photochromic paint 230 and some with no-color 250.

Chopsticks 260—one set blue, one set purple

DESCRIPTION OF THE GAME:

The top cover 210 is flashed, then removed. The first player 270 must try to pick up his colored dumplings 240 with his chopsticks 260 before the color has faded. In his haste and as the colors are fading he might make a mistake, and pick up a colorless one 250 (a dummy) or even his opponents color 230. Taking alternate turns, when both feel each has all his dumplings, each player checks (by flashing) his dumplings. If a player has a dummy 250 or his opponents dumpling, that amount is deducted from his score.

MAGIC MAZES 300 (FIG. 3)

OBJECT OF THE GAME:

The first player to complete the maze wins.

COMPONENTS OF THE GAME:

Game Unit 300—Looks like a book, split & hinged in middle, with top half 310 containing flash unit.

Mazes 322—Patterns printed with an invisible maze which is in fact a blocking pattern.

Markers 360—Wipe off markers—one red and one blue.

DESCRIPTION OF THE GAME:

An invisible maze pattern 322 is placed over what looks like a plain white surface on the top of the lower half 320 of the book. This surface is in fact completely covered with photochromic paint. The cover 310 is closed, triggering a flash. The cover 310 is opened, and the blocking maze pattern 322 removed, thereby revealing a maze 324. The object is to complete the maze, taking alternate turns each time until the pattern disappears, using the kind of markers 360 that can be wiped off with a tissue.

FLASH & MATCH 400 (FIG. 4)

OBJECT OF THE GAME:

The player with the highest point total obtained by matching clues on cards to cities on game board wins.

COMPONENTS OF THE GAME:

Flash Unit 410—Reveals clue on flash card 422.

Flash Cards 422—Has clues and city verifications printed in photochromic ink only revealed by flash unit 410.

Point Markers 424—Marks players progress.

Game Board 420—Playing surface with the names of various cities.

DESCRIPTION OF THE GAME:

The game board 420 is printed with the various cities 426 of the world. When a flash card 422 (which has a number value from 1 to 4) is placed in the flash unit 410, the flash unit operates to reveal a clue to only one correct city. The player places his colored point marker 424 (corresponding to the value on the flash card) on that city 426. Since the clues are more difficult the higher the flash cards number, he can strategically keep pace with other players but can lose his turn more easily. Each player continues his turn until he chooses a wrong city. The game is completed when all of a players markers are on the board.

| CLUES | CITIES |
|---|---|
| "I left my heart . . . ' | San Francisco |
| Fisherman's Wharf | |
| Best U.S. Chinese Food | |
| 49'ers | |

-continued

| CLUES | CITIES |
|---|---|
| North Beach | |
| Space Needle | Seattle |
| Mariners | |
| Supersonics | |
| Seahawks | |
| Largest City | Mexico City |
| Chicimangas | |
| Astrodome | Houston |
| Oilers | |
| Cougars | |
| Angels | Los Angeles |
| Freeway | |
| Bruins | |
| Bel Air | |
| Queen Mary | |
| Rodeo Dr. | |
| Lincoln | Washington, D.C. |
| Jefferson | |
| Patomic | |
| Space Museum | |
| Bill of Rights | |
| Bois De Bolonge | Paris |
| Tulleres | |
| Winged Victory | |
| Eiffel Tower | |
| Arc De Triumph | |
| Metro | |
| "Toddl'n Town" | Chicago |
| Stock Yards | |
| Tallest Building | |
| Michigan Blvd. | |
| "El" | |
| Cubbies | |

What is claimed is:

1. A game apparatus comprising: a housing; a removable lid for covering said housing; means for providing a brief flash of high-intensity illumination; a plurality of playing pieces randomly positioned within said housing to receive the illumination of said flash; individual ones of said playing pieces having means for briefly radiating color-coded visible light after receiving said flash, whereby said color-coded playing pieces form a random pattern of colored light; said housing having dimensions exposing said playing pieces to at least two players who may form impressions of the locations of said playing pieces while they are radiating said light, whereby each player must rely upon this memory as to where his color of playing pieces are located; and means for said players to remove said pieces in turn according to his memory of where colors assigned to him are located.

2. The method of playing a game using apparatus including a housing, a lid, a plurality of color-coded game pieces randomly positioned within said housing, individual ones of said playing pieces having means for briefly radiating color-coded visible light after receiving a high-intensity illumination whereby said color-coded playing pieces form a random pattern of colored light; said method comprising the steps of: associating with each of at least two players at least one color of said color-coded playing pieces; providing a flash of high-intensity illumination; exposing said game pieces to view by said players; memorizing an impression of the positions of said playing pieces while they are radiating said light, whereby each player must rely upon his memory as to where his color of playing pieces are located; and removing said game pieces in turn according to each player's memory of where colors assigned to him are positioned.

* * * * *